United States Patent [19]

Tsumura

[11] 4,430,174

[45] Feb. 7, 1984

[54] METHOD FOR REFINEMENT OF IMPURE ALUMINUM

[75] Inventor: Yoshishige Tsumura, 39-7 Minami-Magome 1 chome, Ohta-ku, Tokyo, Japan

[73] Assignees: Mitsui Aluminium Co., Ltd.; Yoshishige Tsumura, both of Tokyo, Japan

[21] Appl. No.: 445,717

[22] Filed: Nov. 30, 1982

[30] Foreign Application Priority Data

Dec. 1, 1981 [JP] Japan ..... 56-191704

[51] Int. Cl.[3] ..... C25C 3/06

[52] U.S. Cl. ..... 204/67; 204/252; 204/253

[58] Field of Search ..... 204/67, 252, 253

[56] References Cited

U.S. PATENT DOCUMENTS 4,115,215 9/1978 Das et al. ..... 204/67

4,183,745 1/1980 Tsumura ..... 204/67

*Primary Examiner*—M. J. Andrews

*Attorney, Agent, or Firm*—Oblon, Fisher, Spivak, McClelland & Maier

[57] ABSTRACT

Refinement of impure aluminum is accomplished by a method which comprises placing the impure aluminum in a molten form as an anode on one side of a porous article impregnated with a fused-salt electrolytic bath, disposing a cathode on the other side of the porous article, and passing direct current between the cathode and the anode.

11 Claims, 7 Drawing Figures

METHOD FOR REFINEMENT OF IMPURE ALUMINUM

BACKGROUND OF THE INVENTION

This invention relates to a resource-saving, pollution-free method for the production of refined aluminum or aluminum alloys. (Hereinafter, aluminum and aluminum alloys shall, as a rule, be collectively referred to as "aluminum".) More particularly, this invention relates to a method for refining magnesium-containing aluminum by removing magnesium therefrom and to a method for producing aluminum of high purity by refining impure aluminum.

These methods are required to avoid creating environmental pollution particularly in the removal of magnesium and to permit economization of resources particularly in the production of refined aluminum. These requirements are fulfilled by the methods of the present invention.

First, the removal of magnesium will be described.

The treatment of aluminum for the removal of magnesium therefrom is a refinement process most necessary for the recycling of aluminum.

Magnesium, if contained in wrought products of aluminum alloy (containing pure aluminum), improves the mechanical properties of the material without impairing the corrosion-resistance thereof. In this respect, it is a useful alloying element. Aluminum alloys prepared so as to contain up to about 5% of magnesium find widespread acceptance as corrosion-resistant aluminum alloys.

In the case of aluminum alloys for use in die castings, however, magnesium is an unwanted element. Inclusion of magnesium in these aluminum alloys, therefore, is rigidly controlled. For use in castings, aluminum alloys are prepared so as to contain a fairly large proportion of silicon with a view to improving their casting property. Magnesium, if present therein, reacts with silicon to produce an intermetallic compound $Mg_2Si$ which embrittles the alloys. This explains why the presence of magnesium in such aluminum alloys is undesirable.

According to JIS (Japanese Industrial Standard) H5302 titled "Die Casting Aluminum Alloys," the allowable magnesium content in ADC10 and ADC12, which together account for more than 95 percent of the die casting alloys actually used in Japan, is specified as not to exceed 0.3 percent. Most standards adopted by ordinary consumers and those adopted by producers dictate still lower magnesium contents in aluminum alloys. In the case of 380-series alloys which are used in the largest quantities in the United States, the highest allowable magnesium content is 0.10 percent.

About 90 percent of all the die casting alloys are produced by using aluminum scraps as the raw material. In wrought products of aluminum alloys produced today, the average magnesium content is 0.96 percent. It follows as a consequence that the content of magnesium in aluminum scraps generally exceeds the allowable upper limit of magnesium content in die casting alloys. For use in the preparation of die casting alloys, therefore, such aluminum scraps must be given a treatment for removal of magnesium. The processes heretofore employed for the removal of magnesium are such that they have inevitably caused air pollution.

The removal of magnesium from alluminum alloys has heretofore been accomplished exclusively by either of two methods: (1) one method using chlorine gas and (2) another using a fluoride. The former method comprises blowing chlorine gas into a given molten aluminum alloy. Magnesium exhibits a stronger chemical affinity for chlorine than aluminum. By making use of this difference of affinity, magnesium is removed in the form of $MgCl_2$ from the aluminum alloy. The waste gas emanating from this treatment, consequently, contains unaltered free chlorine and aluminum chloride in large proportions and causes air pollution. When chlorine gas is blown into the molten aluminum alloy through a graphite pipe as is usually practiced, the chlorine concentration in the waste gas reaches the level of about 3000 ppm. To lower the chlorine concentration in the waste gas, there have been studied various measures, including those of Bell System Process, Alcoa Process, Derham Process, etc.

With the demagging method which makes use of chlorine gas, however, the waste gas is certained to contain harmful free chlorine and aluminum chlorine.

In the method which resorts to use of a fluoride, aluminum fluoride is mainly used as the fluoride and the reaction shown below is utilized for the removal of magnesium.

$$2AlF_3+3Mg=3MgF_2+2Al$$

This compound, aluminum fluoride, is so expensive as to render this method uneconomical. Moreover, aluminum fluoride undergoes decomposition to give rise to a fluorine compound which causes air pollution. For this reason, this method is not used so widely as the aforementioned method which effects the treatment by use of chlorine.

The inventor of this invention formerly invented a method for effecting removal of magnesium from aluminum without use of any chlorine gas or aluminum fluoride. To this invention have issued Japanese Pat. No. 1,040,009 and U.S. Pat. No. 4,183,745. This method obviates the necessity for using chlorine gas or aluminum fluoride and enables magnesium contained in aluminum, a valuable substance which has heretofore been discarded in the form of magnesium chloride or magnesium fluoride, to be recovered in the form of metallic magnesium. It is, therefore, a resources-saving, pollution-free method.

FIG. 1 represents a typical apparatus used for working the invention of U.S. Pat. No. 4,183,745. In a refractory container 1, molten aluminum bath 2 containing magnesium is contained and an electrolytic bath 3 which is a fused flux layer containing chlorides and/or a fluoride is superposed on the molten aluminum bath 2. The molten aluminum bath 2 is provided with an anode and the electrolytic bath 3 with a cathode respectively. The first problem encountered by this method resides in the fact that "threshold current density" exists on the surface of the molten aluminum bath while the apparatus is in an energized state. When the current density exceeds this threshold, not only magnesium but also aluminum reacts with chlorine and forms aluminum chloride on the surface of the molten aluminum bath. The aluminum chloride thus formed passes into the electrolytic bath 3. On reaching the interior of the electrolytic bath 3, the aluminum chloride which has a lower decomposition voltage than magnesium chloride immediately separates itself and adheres as a deposit 4 to the cathode, giving birth to an alloy of magnesium and aluminum on the cathode. As the aluminum content increases in this alloy of magnesium and aluminum, the alloy gradually gains in specific gravity. When the increased specific gravity of the alloy surpasses the specific gravity of the electrolytic bath 3, the alloy sediments to the lower portion of the electrolytic bath. Consequently, the alloy passes into the molten aluminum bath 2 which is undergoing the treatment for the removal of magnesium and completely spoils the treatment for the magnesium removal. The second problem of this method resides in the fact that an attempt to recover magnesium in the form of pure metal magnesium only results in heavy oxidative consumption of molten magnesium and consequent notable decline of the ratio of recovery.

Now, the method for producing aluminum refined to high purity will be described below. The term "high-purity aluminum" generally refers to aluminum which has purity of at least 99.95% and is suitable for use such as in electrolytic condensers. Heretofore, the high-purity aluminum has been produced by the method of three-phase electrolysis using, as an anode, a molten aluminum alloy which possesses a high specific gravity because of incorporation of about 33% of copper therein. This three-phase electrolysis method has disadvantages such as entailing a high unit power consumption on the order of 18000 to 20000 KWH, involving a high unit consumption of aluminum metal on the order of 1030 to 1050 kg, and inevitably entailing heavy consumption of copper on the order of 5 to 10 kg per ton because the electrolysis requires use of an aluminum alloy with high specific gravity due to incorporation of 30 to 35% of copper as an anode.

An object of this invention is to provide a method for the removal of magnesium from magnesium-containing aluminum, which method avoids creating the cause for environmental pollution and permits magnesium to be recovered in high efficiency.

Another object of this invention is to provide a method for the production of refined aluminum with a low unit power consumption and a low unit aluminum consumption without requiring use of copper.

SUMMARY OF THE INVENTION

This invention is directed to a method for solving the problems suffered by the method of aluminum refining aimed at removal of magnesium and the method of aluminum refining aimed at production of high-purity aluminum. Specifically, it concerns a method for refining impure aluminum by placing the impure aluminum in a molten form on one side of a porous article impregnated with a fused-salt electrolytic bath containing alkali metals and/or an alkaline earth metal, using this impure aluminum as an anode, disposing a cathode on the other side of the porous article, and passing direct current between the electrodes. Although the electrolytic bath alone may be placed on the cathode side during the initial energization of the apparatus, the molten aluminum is generally placed on the cathode side from the beginning.

BRIEF DESCRIPTION OF THE DRAWINGS

Other objects and features of the invention will become apparent to those skilled in the art as the disclosure is made in the following description of preferred embodiments of the invention, as illustrated in the accompanying drawings, in which.

DETAILED DESCRIPTION OF PREFERRED EMBODIMENTS

First, the porous article which has absorbed a fused-salt electrolytic bath will be described. A partition of porous material which permits free penetration of the electrolytic bath and prevents penetration of molten aluminum owing to its high surface tension is disposed between a cathode and an anode. The porous material is caused to absorb a fused salt. Consequently, this partition serves as a diaphragm and, at the same time, fulfills the function of an electrolytic bath layer. The porous material is required to resist corrosion by molten aluminum, the fused-salt electrolytic bath etc. and not to react either with the molten aluminum or with the electrolytic bath at a temperature of 700° C. to 800° C. For example, a shaped article of ceramic fibers having a high alumina content can be used as the porous material for the purpose of this invention. The shaped article of ceramic fibers can be easily obtained in a constitution having an apparent specific gravity of 0.1 to 0.2 Since the true specific gravity of ceramic fibers is 2.73, the shaped article is found by calculation to have a porosity of 96.3 to 92.7%, indicating that this shaped article is mostly occupied by pores. The fused-salt electrolytic bath can freely penetrate into these pores and move and disperse within the pores. Since the molten aluminum has high surface tension, the shaped article of ceramic fibers can fully retain its function as a diaphragm so far as the depth of the molten aluminum is small. Thus, this shaped article can function as a diaphragm and as an electrolytic bath at the same time.

Commercially available ceramic fibers composed preponderantly of $Al_2O_3$ and $SiO_2$ and containing as impurities a small amount of $Fe_2O_3$, $Mg_2O$, etc. can be used for the purpose of the present invention. Of the ceramic fibers, it is preferable to use those having a higher ratio of $Al_2O_3$ to $SiO_2$. However, the content of $Al_2O_3$ may be 40% if the ceramic fiber is used for removal of magnesium. When the ceramic fiber is used for refinement of aluminum, the content of $Al_2O_3$ is preferably at least 80% because $SiO_2$ is reacted with $AlCl_3$. The temperature usable for the ceramic fiber composed of 40% of $Al_2O_3$ and 60% of $SiO_2$ is 1300° C., that for the ceramic fiber composed of 60% of $Al_2O_3$ and 40% of $SiO_2$ is 1500° C., and that for the ceramic fiber composed of 80% of $Al_2O_3$ and 20% of $SiO_2$ is 1600° C.

Figure 1:
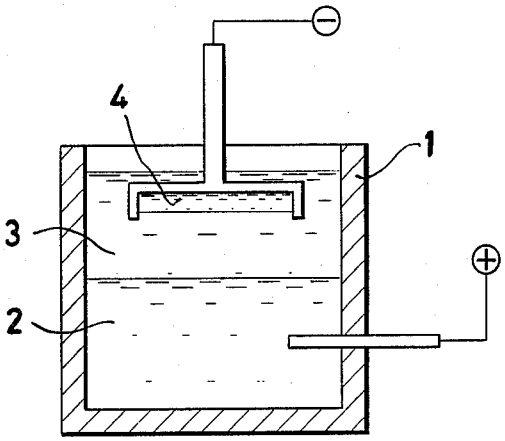
Fig. 1 PRIOR ART
FIG. 1 illustrates a typical apparatus to be used for working the invention of U.S. Pat. No. 4,183,745.
Figure 2:
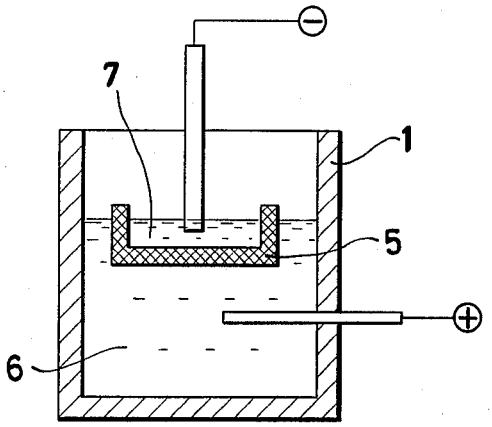
FIG. 2 illustrates a typical apparatus to be used for working the present invention.

FIG. 2 represents a typical apparatus to be used for working the method of the present invention. First, the method for magnesium removal by the use of this apparatus will be described.

In FIG. 2, 5 denotes a porous article which has absorbed an electrolytic bath and which functions concurrently as a diaphragm and an electrolytic bath, 6 denotes aluminum in a molten form required to be treated for removal of magnesium, and 7 denotes pure aluminum in a molten form. The electrolytic bath is formed of a fused salt of chlorides of alkali metals and/or alkaline earth metals. Specifically, the fused salt is sodium chloride, potassium chloride, calcium chloride, or the like in a fused form. Preferably, this fused salt contains therein at least 5%, practically 5% to 60%, of magnesium chloride. When an anode is disposed in the molten aluminum 6 and a cathode in the molten pure aluminum 7 and direct current is passed between the electrodes, chlorine is generated on the surface of the molten aluminum 6 and this chlorine immediately reacts with magnesium in the molten aluminum 6 to produce magnesium chloride, which is absorbed in the electrolytic bath 5 and is not released at all into the ambient air. Consequently, magnesium is separated on the surface of the molten aluminum 7 on the cathode side.

As the current density surpasses the "threshold current density," not only magnesium but also aluminum reacts with chlorine to produce aluminum chloride on the surface of the molten aluminum bath 6. The produced aluminum chloride is immediately absorbed into the electrolytic bath 5 and is not released into the ambient air. In this case, magnesium and aluminum are simultaneously separated on the surface of the molten aluminum 7 serving as a cathode and they are absorbed into the molten aluminum. Compared with U.S. Pat. No. 4,183,745, therefore, it is possible to make the current density larger and to effect the removal of magnesium in a shorter period of time. Further this invention can recover magnesium in a high efficiency because it recovers magnesium not in the form of pure metal but in the form of aluminum-magnesium alloy. When the removal of magnesium from magnesium-containing aluminum is effected by using a magnesium-containing molten aluminum as the anode and a fused chloride bath as the electrolytic bath and passing direct current between the electrodes, the amount of chlorine to be liberated per unit surface area of the molten aluminum increases with the increasing current density and the liberated chlorine comes to react with not merely magnesium but also aluminum, with the result that aluminum chloride is additionally produced and a bend occurs in the current-voltage curve. The corner of this bend represents the boundary to which preferential reaction of only magnesium occurs. The current density at this point is referred to as "threshold current density".

Now the method for the production of aluminum refined to high purity will be described.

The molten aluminum 7 is obtained as refined to high purity when a molten aluminum bath of ordinary purity of 99.7% is used as the molten aluminum bath 6 serving as the anode and the bath of chlorides of alkali metals containing about 5% of aluminum chloride such as a NaCl-LiCl type bath or NaCl-KCl type bath is used as the electrolytic bath in the apparatus of FIG. 2. The method of this invention is superior to the conventional method of three-phase electrolysis in the respect that the refinement can be carried out at a relatively low temperature in the neighborhood of about 700° C. and that when the aluminum metal of purity of 99.7% used as the anode has lost its purity to about 99%, it is taken out and put to use in its unmodified form for the production of Grade 1100. Heretofore, it has been customary to produce Grade 1100 by the addition of iron in the form of an Al-Fe mother alloy to aluminum metal of purity of 99.7%. In this sense, therefore, the method of the present invention can be called a resource-saving measure. In the production of refined aluminum, when the molten aluminum bath on the anode side contains magnesium as an impurity, the magnesium undergoes chlorination before aluminum does and the $MgCl_2$ concentration in the electrolytic bath is consequently increased. This increase of the $MgCl_2$ concentration continues eventually to a point at which Mg separation occurs on the cathode. By this reason, no magnesium-containing aluminum can be used in the molten aluminum bath on the anode side. While calcium, sodium, etc. are similarly elements baser than aluminum, the presence of these elements in the molten aluminum bath is tolerated because they are absorbed in the electrolytic bath. The purity of the refined aluminum obtained by this method is at least 99.95%. In this method, the initial content of magnesium is not limited. There is nothing but the fact that the more the initial content of magnesium, the lower the speed of refinement. When the content of magnesium is high, the apparent current efficiency becomes more than 100% because of natural oxidization.

Figure 3:
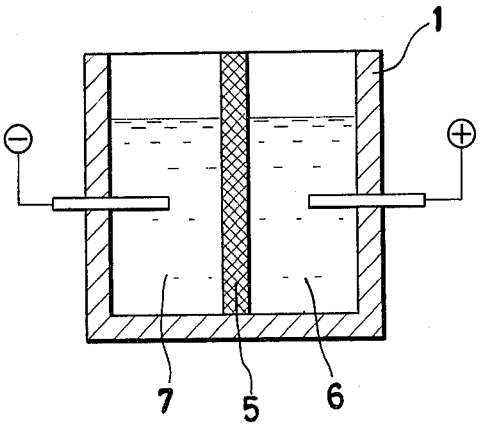
FIG. 3 through FIG. 6 illustrate other apparatuses to be used for working the present invention.
Figure 4:
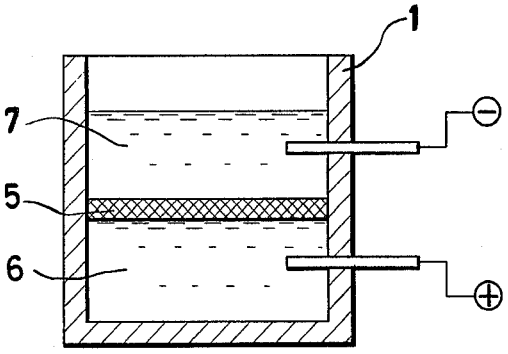
Figure 5:
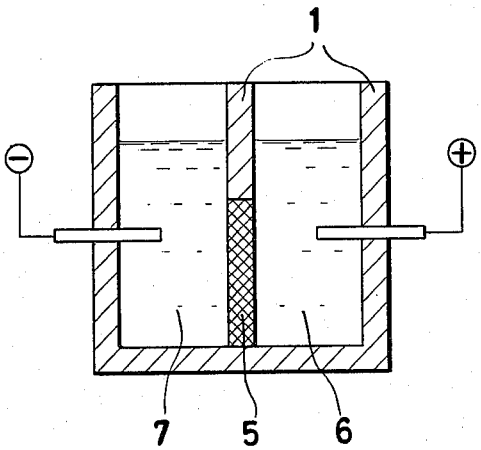
Figure 6:
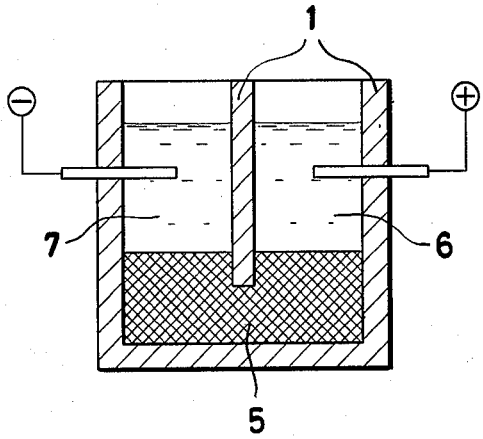

As the apparatus to be adopted for working the present invention, what is illustrated in FIG. 2 is convenient for use with an open well in the existing reverberatory furnace or an iron pot furnace. It can be connected to or disconnected from the furnace as occasion demands. FIGS. 3–6 illustrate various forms of apparatus usable for working the method of this invention. The numerical symbols used in FIGS. 3–6 are identical to those used in FIG. 2. The apparatus of FIG. 3 is convenient when the smelting furnace is provided with an exclusive pouring basin or when the treatment is carried out in the trough for the transfer of molten metal. In this case, there arises a possibility that the molten aluminum will penetrate into the porous material 5 when the depth of the molten aluminum bath increases. This penetration of the molten aluminum into the porous material can be avoided by equalizing or substantially equalizing the specific gravity of the electrolytic bath with that of the molten aluminum. The apparatuses of FIG. 4, FIG. 5 and FIG. 6 prove advantageous where the electrolytic bath is not desired to be exposed to the ambient air such as when the electrolytic bath contains aluminum chloride and the exposure of the electrolytic bath results in volatilization of aluminum chloride and consequent pollution of the ambient air. In this case, the specific gravity of the electrolytic bath is desired to be equal to the specific gravity of the molten aluminum in the apparatus of FIG. 4 or to be greater than the specific gravity of the molten aluminum in the apparatuses of FIG. 5 and FIG. 6. Practically the specific gravity is desired to fall in the range of 0.85 to 1.00 relative to the specific gravity of molten aluminum in the former case and in the range of 1.05 to 1.1 in the latter case. Generally, the specific gravity of the electrolytic bath may be in the range of 0.7 to 0.8 relative to that of aluminum.

The electrolytic bath which is used in the present invention is a fused salt containing chlorides of alkali metals and/or alkaline earth metals. Specifically, this electrolytic bath has the following composition.

For the removal of magnesium from magnesium-containing aluminum:

1. 5 to 22% of $MgCl_2$, 30 to 60% of NaCl, 0 to 20% of KCl, and 20 to 40% of $CaCl_2$
2. 5 to 60% of $MgCl_2$, 20 to 50% of NaCl, and 0 to 45% of KCl For the production of high-purity aluminum:

3. 3 to 10% of $AlCl_3$, 45 to 60% of NaCl, and 35 to 50% of KCl
4. 3 to 10% of $AlCl_3$, 45 to 50% of NaCl, and 45 to 50% of LiCl Although most inexpensive chlorides available for commercial use have, in their fused form, generally lower specific gravities than the specific gravity of molten aluminum, only barium chloride has a higher specific gravity and therefore can be used for varying the combined specific gravity of the fused-salt electrolytic bath. Main chlorides in their fused form show the following specific gravities ($d_t$) at a given temperature.

NaCl: $d_t = 1.549 - 6.261 \times 10^{-4}$(t=800° C.)

KCl: $d_t = 1.535 - 5.6 \times 10^{-4}$ (t=768° C.)

$MgCl_2$: $d_t = 1.682 - 2.9 \times 10^{-4}$ (t=712° C.)

$CaCl_2$: $d_t = 2.085 - 4.4 \times 10^{-4}$ (t=800° C.)

$BaCl_2$: $d_t = 3.12 - 6 \times 10^{-4}$ (t=1000° C.)

Simple calculation performed in accordance with the formula given above on the assumption that the fused salt containing $MgCl_2$ which at 720° C. has a specific gravity identical with the specific gravity 2.352 of molten aluminum does not induce any voluminal change by its incorporation, shows a feasible fused salt composition to be made up of 20 wt % (30.9 mol %) of $MgCl_2$, 6.9 wt % (17.4 mol %) of NaCl, and 73.1 wt % (51.7 mol %) of $BaCl_2$ or 10 wt % (11.8 mol %) of $MgCl_2$, 28.6 wt % (55.0 mol %) of NaCl, and 61.4 wt % (33.2 mol %) of $BaCl_2$. The melting point of the former composition is about 600° C. and that of the latter composition is about 650° C. These fused salt compositions, therefore, prove desirable even in terms of the melting point.

Generally in the smelting furnace, the position of the molten bath level varies incessantly as the raw material is placed in the furnace, melting proceeds, and the molten metal is poured out of the furnace. In the case of the apparatus of FIG. 2 wherein the porous article impregnated with the electrolytic bath is in the shape of a box open at the top and this porous article is held afloat on molten aluminum, part of the walls of the box, such as the lateral walls, are treated in advance so as to be rendered impervious to the fused-salt electrolytic bath and the molten aluminum and, consequently, buoyant in the molten aluminum bath. Consequently, the positional relation between the porous article and the molten aluminum bath along their common boundary is always constant. Thus, the refining of impure aluminum can be easily carried out even during the melting operation without necessitating any adjustment of the position of the porous article relative to the change in the level of the molten bath. Although the method for rendering the porous article impervious to the fused electrolytic bath and the molten aluminum is not specifically limited, methods for joining an impenetrable inorganic material to the surface of the porous article through the medium of an organic adhesive material or a method for lining the porous article with an impenetrable inorganic material are available for the purpose.

Figure 7:
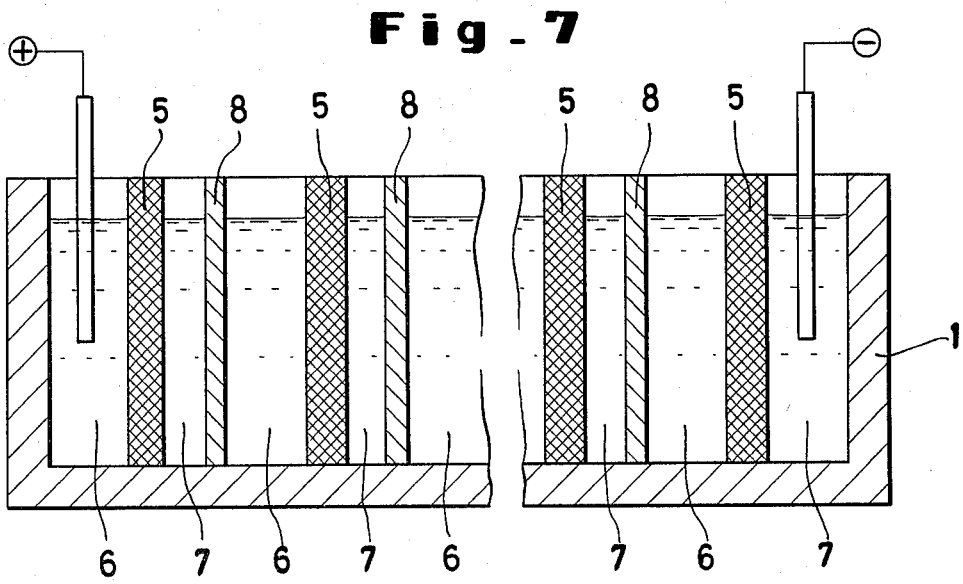
FIG. 7 illustrates a typical apparatus incorporating a plurality of smelting furnaces for working the present invention.

The refining method of the present invention may be carried out on a commercial scale by using an apparatus consisting of an integral aggregate of a plurality of furnaces as illustrated in FIG. 7. As compared with an apparatus using a plurality of furnaces installed separately of one another, the apparatus composed of the integral aggregate of a plurality of furnaces does not suffer heavily from the loss due to conductor resistance and permits the invention to be worked quite efficiently. In FIG. 7, molten impure aluminum 6 and molten aluminum 7 are alternately disposed and porous article 5 impregnated with a fused-salt electrolytic bath and good electric conductors such as graphite plates 8 impervious to molten aluminum are alternatively interposed therebetween. In other words, a plurality of unit combinations each consisting of a molten impure aluminum, a porous article, and a molten aluminum are serially arrayed as interposed by a graphite plate.

In the method of the present invention, since the porous article simultaneously fulfills two functions, one as a diaphragm and other as an electrolytic bath layer, the electrolytic bath layer can have an extremely small thickness as compared with the electrolytic bath layer in any other ordinary electrolytic cell and the electric resistance can be decreased proportionately.

Further, the refinement of impure aluminum as contemplated by the present invention is generally accomplished by disposing molten impure aluminum and molten aluminum on both sides of the porous article impregnated with the fused-salt electrolytic bath at the outset of the refining operation and passing electric current. Optionally, the refinement can be carried out by placing impure aluminum on only one side of the porous article and then starting passage of the electric current. In this case, molten aluminum is produced on the other side of the porous article as the electrolysis proceeds.

Now, the present invention will be described below with reference to working examples of this invention and comparative experiments.

EXAMPLE 1

An apparatus constructed as illustrated in FIG. 2 was used to carry out removal of magnesium from magnesium-containing aluminum in accordance with the method of the present invention.

In a graphite crucible, #8, 2,000 g of molten aluminum alloy containing 0.63% of Mg was held at 720° C. and a graphite electrode bar 10 mm in diameter was inserted as an anode into the molten aluminum alloy bath. A cylindrically shaped article of ceramic fibers 50 mm in inside diameter, 80 mm in outside diameter, 45 mm in inside depth, and 15 mm in bottom wall thickness and 0.20 of apparent specific gravity was placed afloat on the upper surface of the molten bath. Into this shaped article was poured 375 g of an electrolytic bath composed of 18% of $MgCl_2$, 30% of NaCl, 17% of KCl, 34% of $CaCl_2$, and 1% of NaF and fused in advance in a nickel crucible. Most of the electrolytic bath was absorbed in the shaped article of ceramic fibers and the remainder of the electrolytic bath stood to a height of about 8 mm in the bottom of the shaped article.

The shaped article of ceramic fibers had a volume of 213.13 $cm^3$. On the assumption that the porosity of this shaped article is 92.7% and the specific gravity of the electrolytic bath at 720° C. is 1.759, the shaped article of ceramic fibers ought to have a weight of 347.5 g when its pores are completely filled with the electrolytic bath. The difference 27.5 g between this weight and 375 g is equivalent to 15.63 $cm^3$ of volume and 8.0 mm of depth respectively of the electrolytic bath. The height, about 8 mm, of the remainder of the electrolytic bath after the absorption in the shaped article of ceramic fibers, therefore, implies that the pores in the shaped article were filled substantially to capacity with the electrolytic solution.

Into the shaped article of ceramic fibers, 150 g of aluminum metal 99.7% in purity fused in advance in a separate melting furnace was poured and a graphite electrode bar 10 mm in diameter was set fast to serve as a cathode. Then, direct current of 10 A was passed for two hours. At the end of this treatment, the aluminum alloy as the anode was found by analysis to have a Mg content of 0.18%. The result indicates that this treatment lowered the Mg content of the alloy by 0.45% and removed 9.0 g of magnesium. Since the theoretical amount of electricity required for the removal of 1 g of Mg is 2.204 Ah and, therefore, the power consumption of 20 Ah corresponds to 9.074 g of Mg removal, the result indicates that the magnesium removal was effected at a current efficiency of 99.2%.

The aluminum as the cathode was found by analysis to have a magnesium content of 5.29%, a level corresponding to the specification of the casting grade aluminum alloy AA514, indicating that this aluminum could be used in its unmodified form as AA514. The amount of magnesium separated at the cathode totalled 8.38 g, indicating that 93.1% of the 9.0 g of the removed magnesium was actually recovered. Thus, the recovery of magnesium was obtained with high efficiency and the recovery ratio of magnesium was high as well.

EXAMPLE 2

In the same graphite crucible, #8, as used in Example 1, 2,000 g of molten aluminum alloy bath containing 0.65% of Mg was held at 720° C. and a graphite electrode bar 10 mm in diameter was immersed in the bath as an anode. A shaped article of ceramic fibers having entirely the same size as the shaped article used in Example 1 was floated in the bath. In this shaped article, there was poured 450 g of an electrolytic bath of the same composition as involved in Example 1 fused in advance in a nickel crucible. Most of the fused bath was absorbed in the shaped article of ceramic fibers and the remainder stood to a height of about 30 mm within the shaped article. A graphite electrode bar 10 mm in diameter was inserted as a cathode into the electrolytic bath. Direct current of 10 A was passed for two hours. At the end of this treatment, the aluminum alloy as the anode was found by analysis to have a magnesium content of 0.20%. The result indicates that the treatment lowered the magnesium content by 0.45% and removed 9.0 g of magnesium from 2,000 g of the molten bath. The current efficiency of this treatment for magnesium removal was 99.2%, similarly to the treatment in Example 1. The pure magnesium particles which separated at the cathode were cooled and weighed to be 7.1 g, a value corresponding to 78.2% of the theoretical amount of separation, 9.074 g.

EXAMPLE 3

An apparatus constructed as illustrated in FIG. 2 was used to produce aluminum refined to high purity by the method of this invention.

In a crucible, #8, 2,000 g of fused aluminum bath having purity of 99.7% and containing 0.12% of Fe and 0.05% by Si was held at 720° C. and a graphite electrode 10 mm in diameter was inserted as an anode. A shaped article of ceramic fibers having the same size as in Example 1 was set afloat in the molten aluminum bath. In this shaped article, 365 g of an electrolytic bath consisting of 4% of $AlCl_3$, 48% of NaCl, and 48% of LiCl (having a specific gravity of 1.570 at 720° C.) fused in advance in a nickel crucible was poured. Consequently, most of the electrolytic bath was absorbed in the shaped article of ceramic fibers and the remainder thereof stood to a height of about 10 mm in the shaped article. To remove from the electrolytic bath the impurities such as Fe, Si, Cu, and Zn contained therein and effect the refinement by electrolysis, 30 g of molten aluminum bath 99.7% in purity was placed, a graphite electrode bar 10 mm in diameter was inserted therein as a cathode, and direct current of 20 A was passed for one hour. Then the molten aluminum bath was extracted with a syringe and 30 g of high-purity aluminum containing 0.003% of Si, 0.003% of Fe and 0.001% of Cu as impurities was placed instead, followed by four hours' passage of direct current of 20 A. At the end of this treatment, the cathode on cooling weighed 54.50 g. There was separated 24.50 g of aluminum. The result implies an increase in weight.

Since the amount of electricity required for depositing 1 g of aluminum is 2.98 Ah, the power consumption of 80 Ah corresponds to separation of 26.85 g of aluminum. Thus, the foregoing result indicates that the treatment involved a current efficiency of 91.2%.

The refined aluminum was found by analysis to contain 0.004% of Si, 0.003% of Fe, and 0.001% of Cu, indicating that the treatment produced aluminum of high purity. In other words, 24.5 g of the molten aluminum on the anode side was separated as refined aluminum on the cathode side.

EXAMPLE 4

An apparatus constructed as illustrated in FIG. 3 was used to remove magnesium from molten aluminum by the method of this invention.

In a graphite crucible, #8, a porous plate of ceramic fibers 10 mm in thickness was disposed as a partition 5 at the center. (The partition is denoted by the numerical symbol 5 because it was a porous article.)

The graphite crucible provided with the partition was heated to and kept at 720° C. in an electric furnace. An electrolytic bath weighing 500 g and consisting of 10% of $MgCl_2$, 28.6% of NaCl, and 61.4% of $BaCl_2$ fused in advance in a nickel crucible was poured into the cavity of the crucible on the lefthand side of the partition. The electrolytic bath was amply absorbed in the ceramic fiber plate until the remainder thereof stood to a height of about 30 mm in the cavity.

1 kg of aluminum alloy containing 1.31% of Mg molten in advance in a separate melting furnace was poured into the cavity of the crucible on the righthand side of the partition and a graphite electrode bar 10 mm in diameter was inserted therein as an anode. Further, 1 kg of aluminum metal 99.7% in purity molten in advance in a separate melting furnace was poured into the cavity of the crucible on the lefthand side of the partition and a graphite electrode bar 10 mm in diameter was set fast as a cathode. Direct current of 20 A was passed for one hour. Then, the anode aluminum alloy was found by analysis to have a Mg content of 0.41%. The result indicates that the treatment lowered the Mg content by 0.90% and removed 9.0 g of magnesium from 1 kg of molten bath. It also indicates that the reaction for the removal of magnesium had a current efficiency of 99.2%.

The cathode aluminum was found by analysis to have a magnesium content of 0.83%, indicating that the cathode aluminum could be used as a 5000-type alloy or as a raw material for the formulation of casting grade aluminum alloy containing magnesium.

What is claimed is:

1. A method for refining impure aluminum, which comprises:

(a) placing said impure aluminum in a molten form into a container on one side of a porous article impregnated with a fused-salt electrolytic bath containing at least one metal selected from the group consisting of alkali metals and alkaline earth metals with electrical connection being made to said impure molten aluminum so that if serves as an anode;

(b) disposing a cathode of molten aluminum on the remaining side of said impregnated porous article;

(c) passing direct current between said cathode and said anode with the result that chlorine gas is generated in said porous article which reacts with impurities in said molten impure aluminum functioning as an anode, thereby forming chloride salts which migrate across said porous article and accumulate in the molten aluminum cathode; and (d) recovering refined aluminum from the container of step (a).

2. The method of claim 1, wherein said molten impure aluminum in the container of step (a) as an anode is aluminum containing magnesium, said magnesium impurity being substantially removed from said molten aluminum by the electrolytic process.

3. The method of claim 2, wherein said impregnated fused-salt electrolytic bath contains magnesium chloride.

4. The method of claim 1, wherein the impurity of said molten impure aluminum in the container of step (a) is at least one element selected from the group consisting of metals nobler than aluminum and alkaline metals, and wherein the impregnated fused-salt electrolytic bath contains aluminum chloride, so that upon electrolysis the deposition of aluminum is induced in high purity on the cathode.

5. The method of claims 1, 2, or 4, wherein said porous article is a box which has been partially treated to acquire a degree of imperviousness and wherein said box is open at its top, said box containing molten aluminum therein, the outer surface of said box adjoining said molten impure aluminum, and said box floating on said molten impure aluminum.

6. The method of claim 1, wherein the specific gravity of said fused-salt electrolytic bath is 85 to 100% of the specific gravity of the molten aluminum of said cathode.

7. The method of claim 1, wherein the specific gravity of the fused-salt electrolytic bath is not less than 100% of the specific gravity of the molten aluminum of said cathode.

8. The method of claim 1, wherein said fused-salt bath, being especially effective for the removal of magnesium from magnesium containing aluminum, comprises a mixture of (1) 5 to 22% $MgCl_2$, 30 to 60% NaCl, 0 to 20% KCl and 20 to 40% $CaCl_2$ or a mixture of (2) 5 to 60% $MgCl_2$, 20 to 50% NaCl and 0 to 45% KCl.

9. The method of claim 1, wherein said fused-salt bath, especially useful for the production of high purity aluminum, comprises a mixture of (1) 3 to 10% $AlCl_3$, 45 to 60% NaCl and 35 to 50% KCl or a mixture of (2) 3 to 10% $AlCl_3$, 45 to 50% NaCl, and 45 to 50% LiCl.

10. The method of claim 1, wherein said porous article is an article of shaped, high alumina content ceramic fibers having an apparent specific gravity of 0.1 to 0.2.

11. The method of claim 1, wherein the temperature of the electrolytic refining process is in the neighborhood of 700° C.

* * * * *